US007188498B2

(12) United States Patent
Browne et al.

(10) Patent No.: US 7,188,498 B2
(45) Date of Patent: Mar. 13, 2007

(54) RECONFIGURABLE TOOLS AND/OR DIES, RECONFIGURABLE INSERTS FOR TOOLS AND/OR DIES, AND METHODS OF USE

(75) Inventors: Alan L. Browne, Grosse Pointe, MI (US); Vidyashankar R. Buravalla, Banglore (IN); Nancy L. Johnson, Northville, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/293,881

(22) Filed: Dec. 2, 2005

(65) Prior Publication Data

US 2006/0137424 A1 Jun. 29, 2006

Related U.S. Application Data

(60) Provisional application No. 60/638,769, filed on Dec. 23, 2004.

(51) Int. Cl.
*B23P 11/02* (2006.01)
*B21D 9/15* (2006.01)
*B30B 12/00* (2006.01)

(52) U.S. Cl. ..... 72/62; 72/342.7; 29/421.1; 29/405.2; 148/402; 419/68; 425/405.2; 425/78

(58) Field of Classification Search ..... 72/62, 72/342.7; 100/163 R, 41; 425/405.2, 78; 29/421.1, 447, 405.2; 148/402; 419/68, 419/49

See application file for complete search history.

(56) References Cited

U.S. PATENT DOCUMENTS 4,732,556 A * 3/1988 Chiang et al. ..... 425/405.2
4,738,610 A * 4/1988 Chiang et al. ..... 425/405.2
4,797,085 A * 1/1989 Chiang et al. ..... 425/405.2
5,265,456 A * 11/1993 Kennedy et al. ..... 72/342.7
6,668,711 B1 * 12/2003 Villiger ..... 100/163 R
6,701,764 B2 * 3/2004 Bruck et al. ..... 72/62

* cited by examiner

*Primary Examiner*—David Jones
(74) *Attorney, Agent, or Firm*—Kathryn A. Marra

(57) ABSTRACT

A reconfigurable tool and/or die geometry and methods of use generally comprise forming at least a portion of a shape defining surface with a shape memory material. In response to an activation signal, the shape memory material changes geometry of the shape defining surface to provide a means for forming parts with different geometries from the same tool and/or die. In an alternative embodiment, an insert for a tool and/or die can be used, wherein the insert has at least a portion of its shape defining surface formed of a shape memory material. Also disclosed are processes for forming a first part with a defined geometry and a second part with a defined geometry different from the first part defined geometry using a reconfigurable tool and/or die as well as a reconfigurable insert with a standard tool and/or die.

23 Claims, 6 Drawing Sheets

RECONFIGURABLE TOOLS AND/OR DIES, RECONFIGURABLE INSERTS FOR TOOLS AND/OR DIES, AND METHODS OF USE

CROSS REFERENCE TO RELATED APPLICATIONS

The present application relates to and claims priority to U.S. Provisional Patent Application No. 60/638,769, filed on Dec. 23, 2004, incorporated herein by reference in its entirety.

BACKGROUND

The present disclosure generally relates to reconfigurable tools and/or dies. The reconfigurable tools and/or dies can be adapted to manufacture components or parts having different geometries using the same tool and/or die.

For the process of forming metallic or plastic components, it is common practice to have different tools and/or dies. Different tools and/or dies are necessary to manufacture even those components that have only certain minimal differences in geometry or dimension. Moreover, if a component needs to be formed into different configurations that have only minimal geometric or dimensional changes, different tools/dies are employed. As a result, a manufacturer generally must expend significant resources to accommodate the variety of tools and/or dies necessary to manufacture a variety of components. The resources include not only the financial costs of stocking the various tools and/or dies, but also include the cases associated with changing the tool and/or dies between the different forming operations.

Accordingly, there is a need for a reconfigurable tool and/or die that can be utilized for manufacturing different components, wherein the reconfigurable tool and/or die can be selectively altered to accommodate more than one component configuration.

BRIEF SUMMARY

Disclosed herein are reconfigurable tools and/or dies, as well as inserts that can be selectively altered to accommodate more than one part or component configuration using the same tool and/or dies. In one embodiment, a reconfigurable tool and/or die comprises a male portion comprising a shape defining surface; a female portion comprising a shape defining surface; and a shape memory material forming at least a portion of a selected one or both of the shape defining surfaces of the male and female portions, wherein the shape memory material selectively changes a geometry of the selected one or both of the shape defining surfaces in response to an activation signal.

An insert for a tool and/or die comprises a shape memory material having a shape defining first surface adapted to change to a shape defining second surface in response to an activation signal, wherein the first and second surfaces have different geometries.

A process for forming a first part with a defined geometry and a second part with a defined geometry different from the first part defined geometry using a reconfigurable tool and/or die comprises forming the first part with the reconfigurable tool and/or die, wherein the reconfigurable tool and/or die comprises a shape defining surface comprising at least a portion formed of a shape memory material, wherein forming the first part with the reconfigurable tool and/or die produces the first part with the defined geometry; activating the shape memory material to change the shape defining surface; and forming the second part with the changed shape defining surface to produce the second part with the defined geometry, wherein the second part defined geometry differs from the first part defined geometry.

In another embodiment, a process for forming a first part with a defined geometry and a second part with a defined geometry different from the first part defined geometry using a tool and/or die set comprises inserting an insert into a tool and/or die set, wherein the insert comprises a shape memory material having at least one shape defining first surface adapted to change to a shape defining second surface in response to an activation signal, wherein the first and second shape defining surfaces have different geometries; contacting a blank with the insert and the tool and/or die set to form the first part with the defined geometry; activating the shape memory material to change the shape defining first surface to a shape defining second surface; and contacting an additional blank or the first part with the shape defining second surface of the insert and the tool and/or die set to form the second part with the defined geometry, wherein the second part defined geometry differs from the first part defined geometry.

In another embodiment, a fixture for holding a tool comprises a housing rotatably coupled to a torsional spring, the torsional spring comprising a shape memory material that changes at least one attribute of the shape memory material in response to an activation signal, wherein the change in the at least one attribute rotates the housing about a central axis; and an arm extending from the housing.

The above described and other features are exemplified by the following figures and detailed description.

BRIEF DESCRIPTION OF THE DRAWINGS

Referring now to the figures, which are exemplary embodiments and wherein the like elements are numbered alike.

DETAILED DESCRIPTION

Disclosed herein are reconfigurable tools and/or dies that can be selectively reconfigured to form or mold different components and/or parts or differing geometries of the same part using the same tool and die. The reconfigurable tools and/or dies comprise a shape memory material that can be selectively activated to provide the tool and/or die with different geometries. In this manner, the same tool and/or die can advantageously be used to produce parts or components having different geometries, thereby providing a significant commercial advantage to the manufacturing process. The shape memory material can be integrated with the tool and/or die, in whole or in part, or may be in the form of an insert for use with a standard tool and/or die. Also disclosed herein are reconfigurable fixtures and/or jigs that utilize the shape memory material in a similar manner to provide, for example, active and selective positioning of a part and/or component to be processed.

Advantageously, the reconfigurable fixture and/or jigs can be employed in flexible manufacturing systems so as to eliminate prior art passive positioning mechanisms such as drive screws, cams, solenoids, and the like. Since the general properties of the shape memory materials are well known from published literature, they will not be described in further detail.

Figure 1:
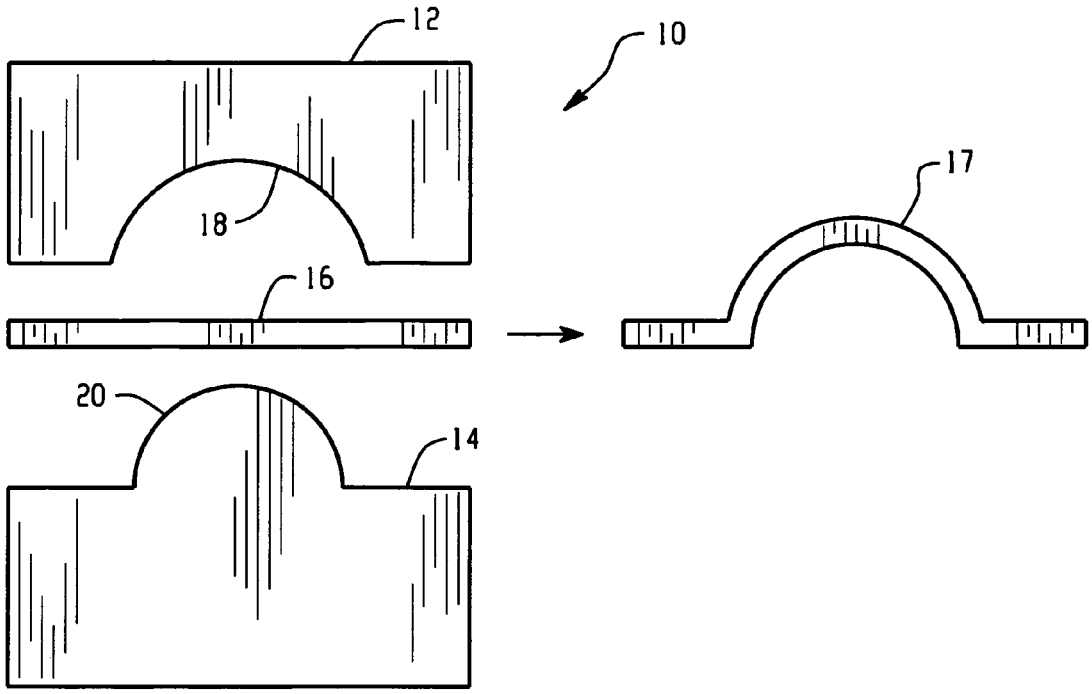
FIGS. 1 and 2 schematically illustrate a reconfigurable tool and/or die for forming parts or components having different geometries.

Turning now to FIG. 1, there is shown a reconfigurable tool and/or die assembly generally designated 10 comprising a female die 12 and a male die 14. During operation, the female portion 12 and the male portion 14 are mated together so as to shape a blank 16 disposed therebetween. The illustrated reconfigurable tool and/or die assembly 10 is intended to be exemplary and is not intended to be limited to any particular form or shape. Likewise, the blank is not intended to be limited to any particular shape. In this particular example, the blank 16 is depicted as a substrate having planar surfaces. However, it should be apparent in view of this disclosure that suitable blanks may comprise a variety of differently shapes and geometries, wherein the term "blank" can generally be defined as the component or part being processed by the reconfigurable tool and/or die. The blank 16 can be made of any deformable and/or moldable material. For example, the blank can be a thermoplastic, a baroplastic, a metal, and the like. The blank is not intended to be limited to any specific type or class of material.

Figure 2:
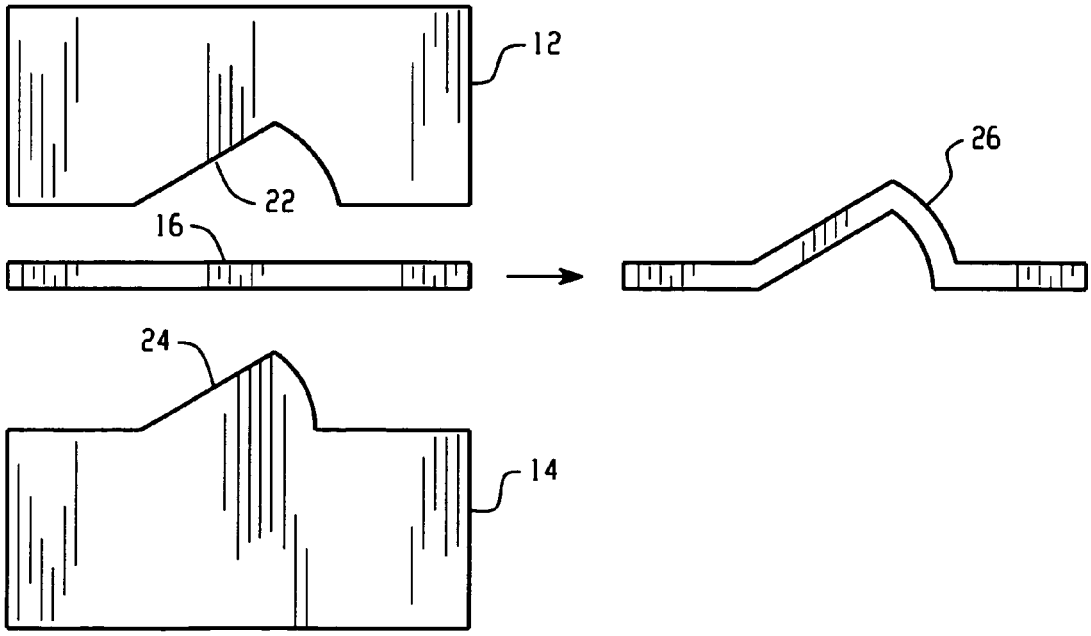

As shown in FIG. 1, the reconfigurable tool and/or die 10 is initially configured to provide a blank 16 with a half-circle shape 17 upon mating of the female die 12 with the male die 14. The female die 12 includes a recess 18 in the shape of a half circle whereas the male die 14 includes a protrusion 20 that is in the shape of a half circle, wherein the locations of the protrusion 20 and the recess 18 are complementary. Once a desired number of blanks 16 are shaped in this manner, the reconfigurable tool and/or die 10 can be reconfigured to produce a blank 16 with different shape, e.g., a pie shape as shown in FIG. 2. At least the portions of the respective dies that define the different geometries to the processed blank are formed of the shape memory material or are in a cooperative relationship with the shape memory material. To effect the change geometry, the tool and/or die is reconfigured by activating the shape memory material. As is well known by those skilled in the art, shape memory materials generally comprise materials wherein the shape and/or modulus properties can be selectively varied by means of an applied activation signal. By activating the shape memory material, the geometry of the tool and/or die changes, which is then used to form the blank 16. For example, as shown, the shape memory material portions of the female and male die parts 12, 14 include regions that define the geometrical shape of the blank, which shape changes from its initial half circle shape configuration 18, 20 shown in FIG. 1 to a pie shape configuration 22, 24, respectively, shown in FIG. 2. As such, blanks 16 processed with the same tool and/or die 10 after reconfiguration form parts 26 having a different geometry than previously obtained, e.g., part 17.

By use of the shape memory material as described above, a single tool and/or die, made either in part or in whole of shape memory material, can be adapted to manufacture two (using a one-way shape memory effect as will be discussed below) or three (using a 2-way shape memory effect as will be discussed below) different parts (i.e., components) or a component requiring multiple forming operations with only certain minimal shape and dimensional changes between them. For example, shape memory alloys are shape memory materials that can exhibit a one-way shape memory effect or a two-way shape memory effect depending on the composition. The two-way shape recovery provides the ability to recover both a high temperature form and a low temperature form whereas the one-way shape recovery only provides the ability to recover one such form. If a single tool or die contains multiple regions of active material that can be independently activated, then many different components/part geometries can be manufactured with the same tool/die, the number being limited only to the number of possible combinations of activated regions.

The change in geometry or dimension (reconfiguration) to be achieved in different forming operations is obtained by selectively inducing phase transformations in the shape memory material(s) in the tool and/or die by activation of the shape memory material. The particular type of phase transformation will depend on the type of shape memory material used, e.g., shape memory alloys can undergo a martensite to austenite phase transformation of its crystal structure. Likewise, activation can be achieved by various means including, but not limited to, magnetic, electrical, thermal, stress activation and combinations comprising at least one of the aforementioned activation signals. The desired configurations for the tool and/or die are memorized into the shape memory material by a training process carried out a priori. Of course, it should be apparent to those in the art that the pressures and temperatures employed in the actual forming process will need to take into consideration the properties of the particular shape memory material employed so that the desired dimensional changes can occur.

As previously indicated, the whole tool and/or die or portions of the tool and/or die could be made of shape memory materials. Examples of the latter include a die with just a surface layer (on the female portion, the male portion, or both portions of the die) made of shape memory materials and a die in which just sections/portions/regions are made of the shape memory material. Advantageously, the reconfigurable tool and/or die can be used for producing globally similar parts with however regional differences, these regional differences being effected through activation of the shape memory material portions of the die.

Figure 3:
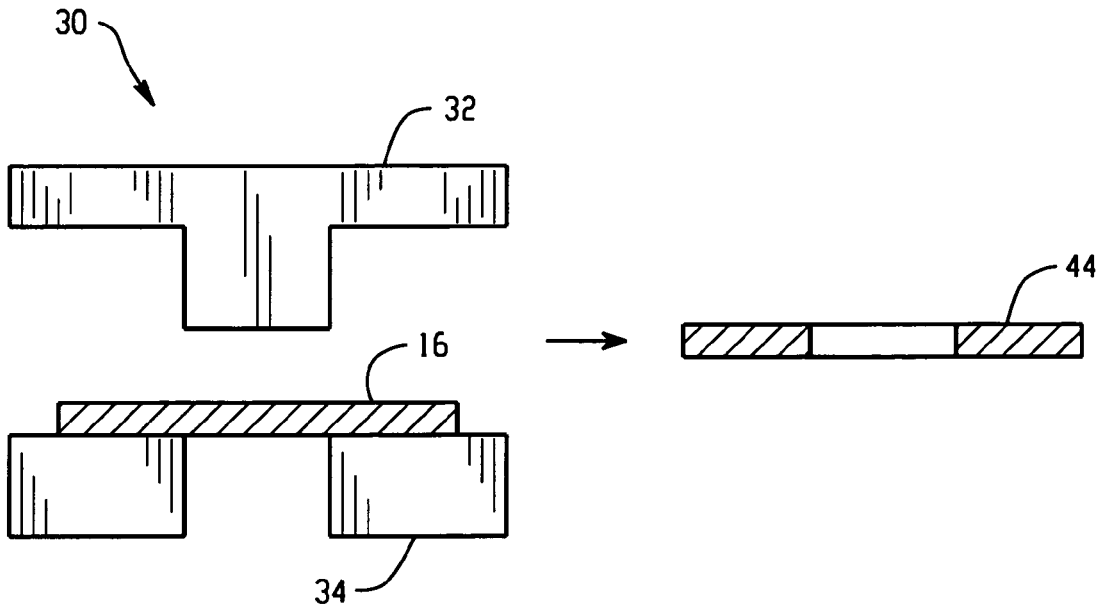
FIGS. 3 and 4 schematically illustrate a reconfigurable tool and/or die for punching parts or components having different geometries.
Figure 4:
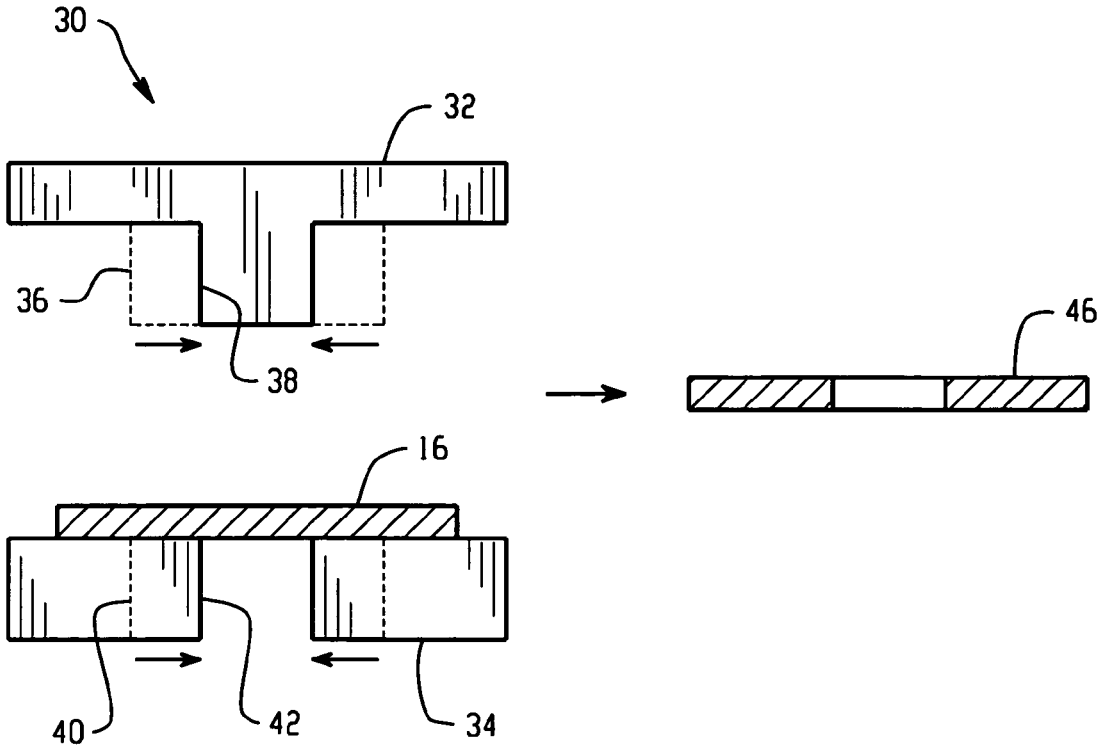

FIGS. 3 and 4 schematically illustrate a reconfigurable tool and/or die assembly generally designated 30 adapted for drawing and/or punching operations. The illustrated reconfigurable tool and/or die 30 generally includes a T-shaped male die 32 and a female die 34 for the punching or the drawing of the blank 16. One or both dies, 32 and/or 34, comprise a shape memory material for altering the shape of the respective male and/or female portions 32, 34. The shape memory material is disposed in whole or in part of the respective female and/or male portions 32, 34 in the manner as previously described. As shown more clearly in FIG. 4, the shape memory material is activated to effect reconfiguration of the tool and/or die from a first shape to a second shape e.g., 36 to 38 and/or 40 to 42. The effect of activation of the shape memory material is illustrated as a change in the lateral dimensions of the male and female dies 32, 34 as shown by the dotted line structure, which effectively decreases the punched area. As such, the die 30 can produce blanks having different punched geometries 44, 46. Similarly, the die 30 can be configured to produce blanks 16 having different geometries as a result of drawing operations, e.g., different thicknesses.

It should be noted that the reconfigurable tool and/or die illustrations shown in FIGS. 1–4 are merely exemplary. Other variations and dimensional changes will be apparent to those skilled in the art in view of this disclosure.

The reconfigurable tool and/or die disclosed herein can also be adapted to provide finish attributes to a previously processed blank. Advantageously, the finished attributes can be imparted in the same tool and/or die once the general shape of the blank has been defined. In these examples the configuration of the tool and/or die is static and a reconfigurable insert formed of the shape memory material is used.

Figure 5:
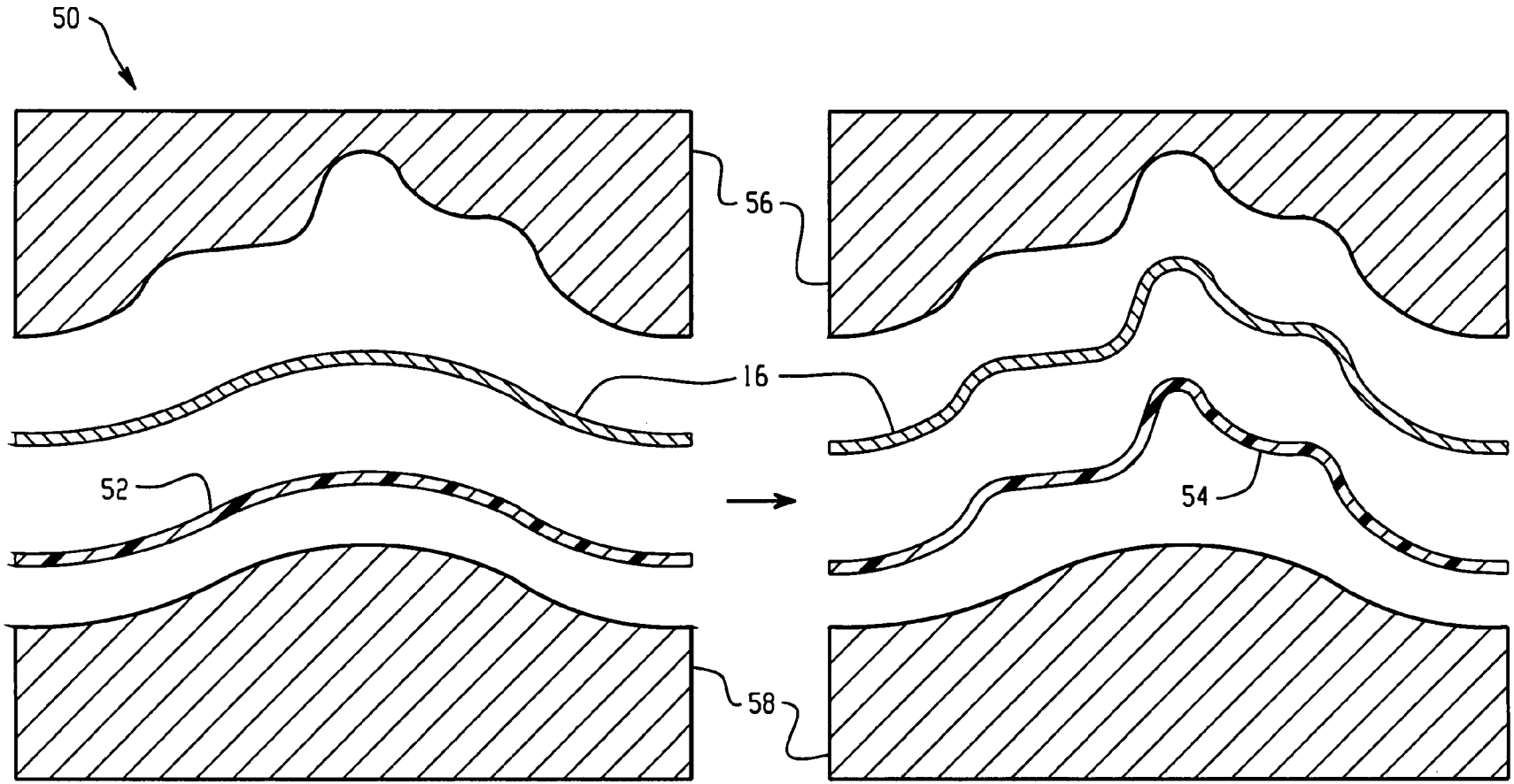
FIG. 5 schematically illustrates a reconfigurable insert for a standard tool and/or die for forming parts or components having different geometries.

By way of example, as shown in FIG. 5, an insert 52 formed of the shape memory material can be employed with a standard tool and/or die 50 (non-reconfigurable) that generally includes a male die 58 and a female die 56. However, it should be noted that the reconfigurable insert could be utilized in a reconfigurable tool and/or die as may be desired for some applications. Although one insert is illustrated, the disclosure is not intended to be limited to one. Additional inserts can be employed in the tool and/die to provide localized changes upon selective activation so as to produce a variety of different geometries and finish attributes to the parts being processed. As shown, the insert 52 is positioned between the male die 58 and the blank 16. Global features are first imparted to the blank 16, which closely approximates the contoured surface of the male die 58. The shape memory insert 52 can subsequently be activated to provide greater detail as shown by the reconfigured insert 54. In this example, once activated, the reconfigured shape memory insert 54 exhibits a shape change to approximate the shape of the female die 56, which can then be transferred to the blank 16 upon mating of the female and male dies, 56, 58.

The insert 52 formed of the shape memory material can be utilized for multiple dies or alternatively, multiple inserts can be employed for the same die. As such, the tool and dies employing the inserts are extremely versatile. For example, parts with minimal changes in features such as dashboards for different vehicles can be machined without having to use separate tools and dies for each step of the machining or forming process.

In one embodiment (such as is shown in FIG. 5), the trained shape of the insert 52 to which it returns upon activation is that with a defined surface feature. In operation, the reconfigurable insert 52 can be totally passive and not impart the special feature on the blank 16 or may be activated after the dies 56, 58 are closed to impart the surface feature. In the latter case, the insert now having the shape as the insert shown by reference numeral 54, if made of a one-way shape memory material, should, after deactivation, be re-stamped prior to reuse in order to return the insert 54 to the original geometry of the insert 52.

Figure 6:
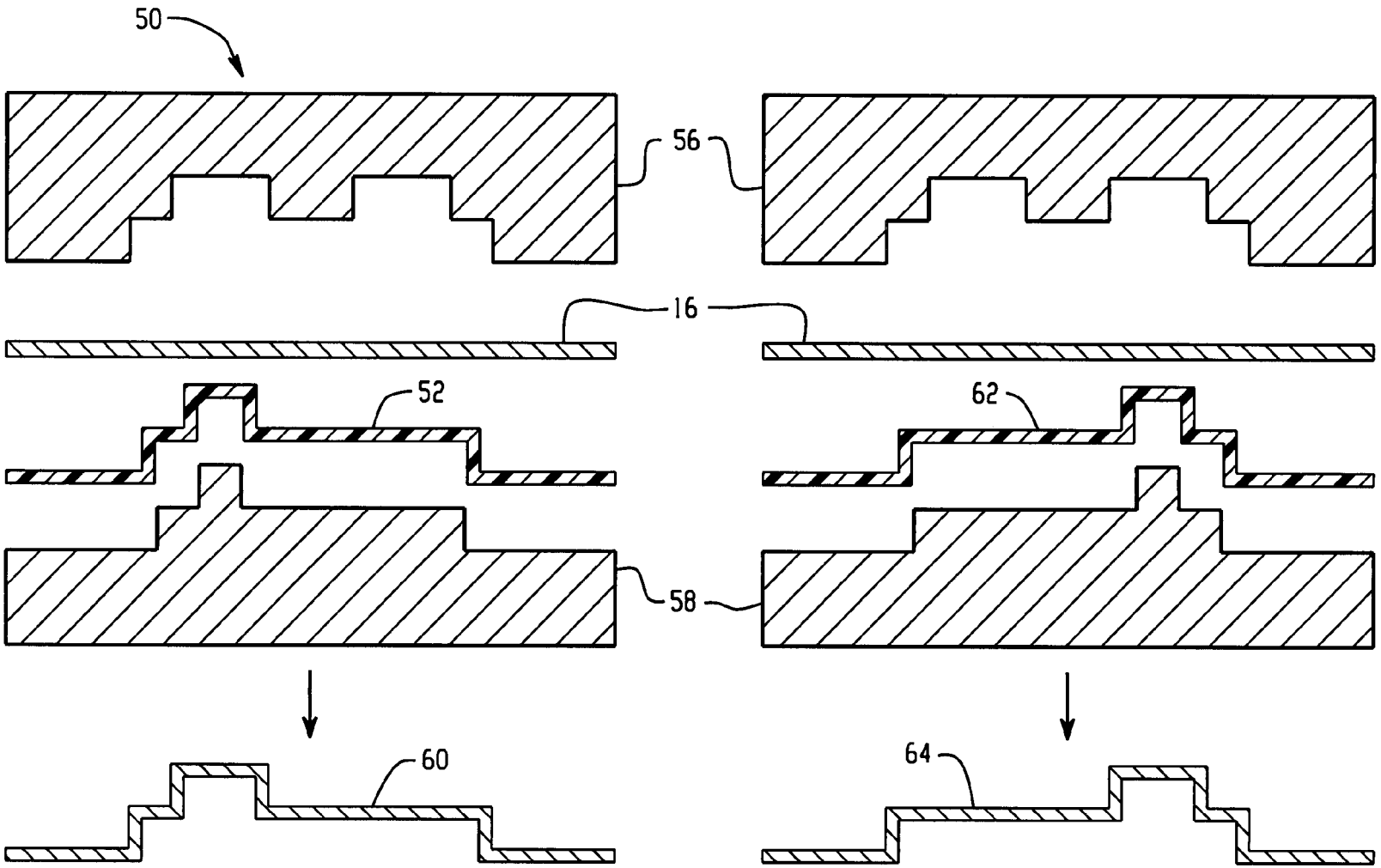
FIG. 6 schematically illustrates multiple reconfigurable inserts for use with a standard tool and/or die for forming parts or components having different geometries schematically illustrates a reconfigurable insert for a standard tool and/or die for forming parts or components having different geometries in accordance with another embodiment.

In another embodiment, multiple reconfigurable inserts can be used with standard tool and/or die 50 (non-reconfigurable) that generally includes the male die 58 and the female die 56 as shown in FIG. 6. The female die 56 is configured with one or more geometrical features. The male die 58 includes some common complementary portions to permit mating of the female die to the male die but lacks some of complementary geometrical features found in the female die. Upon closing the dies 56, 58, the first reconfigurable insert 52 (e.g., an insert formed of a shape memory alloy in its non-activated lower temperature lower modulus state) is activated so as to correspond to the geometry of the particular female die to produce part 60. Upon opening the dies 56, 58 and after blank removal, the insert 52 can be returned to its original geometry. A second reconfigurable insert 62 can then be used to selectively impart other features. The reconfigurable inserts 52, 62 can thus be used repeatedly upon activation of the shape memory material required between forming of parts with differing geometries in contrast to the embodiments in which mechanical reforming is required.

Figure 7:
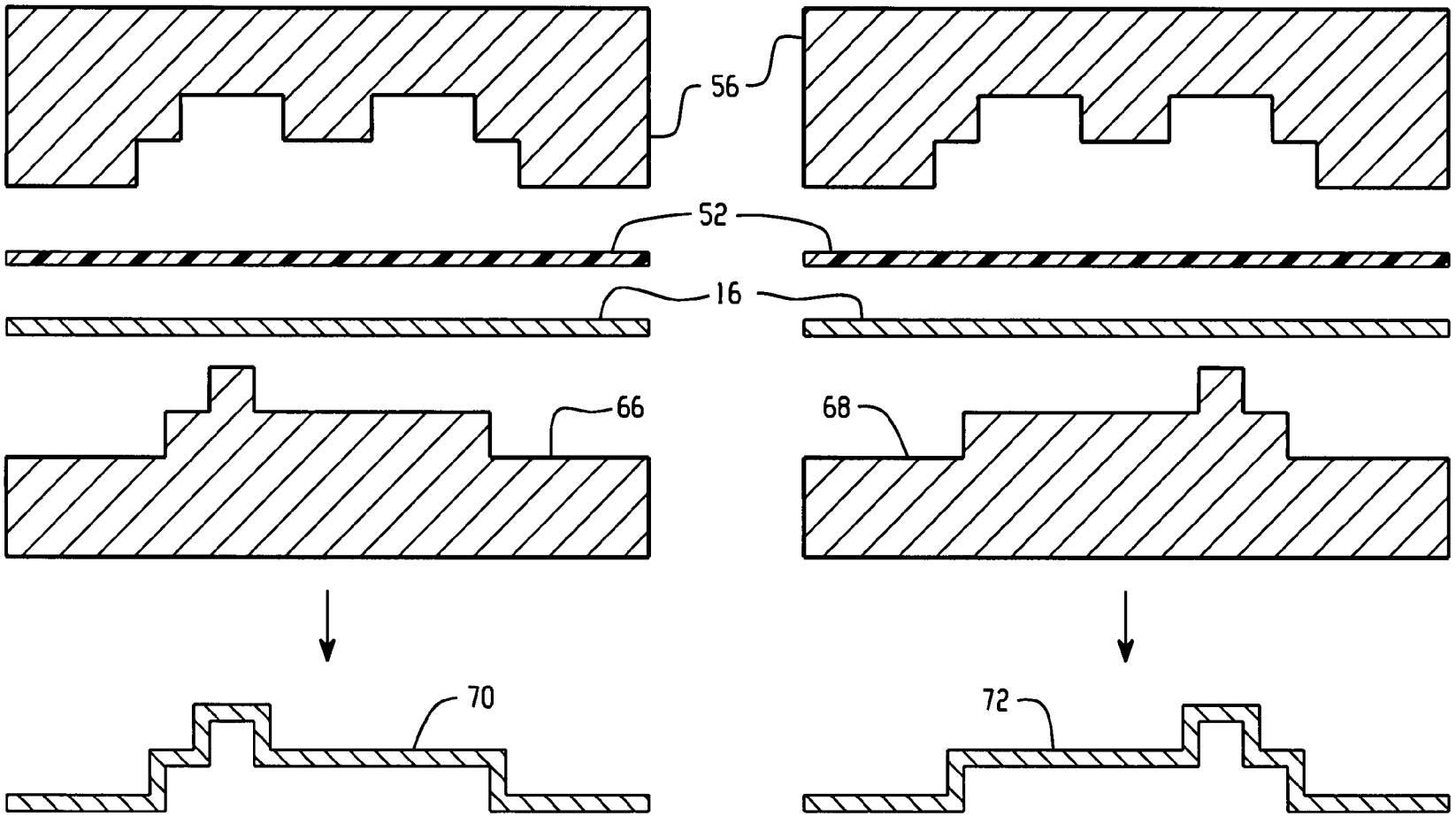
FIG. 7 schematically illustrates a reconfigurable insert for a standard tool and/or die for forming parts or components having different geometries in accordance with another embodiment.

FIG. 7 schematically illustrates another embodiment that employs a single reconfigurable insert 52 to produce a variety of parts having different geometries. The insert 52 is placed between the blank 16 and the female die 56. The female die 56 includes multiple features and is used repeatedly whereas multiple male dies 66, 68 having specific features are employed. By way of example, male die 66 has a raised protrusion located on the left side as shown. Mating the female die 56 having the multiple features with this particular male die 66 and including the blank 16 to be shaped along with a reconfigurable insert 52 can produce part 70. Upon closing the dies, the insert 52 (example SMA in its non-activated lower temperature lower modulus state) is deformed so as to correspond to the geometry of the particular male die. Upon opening the dies and after part removal, the insert 52 can be returned to its original geometry simply by reheating. A single insert can thus be used repeatedly with only activation of the active material required between forming of parts with differing geometries in contrast to other embodiments in which mechanical reforming is required. Replacing male die 66 with male die 68 results in parts 72 being produced. Using shape memory alloys as an exemplary material for forming the insert 52, this embodiment involves stress-induced superelasticity in the shape memory alloy insert. Because of this, the insert 52 will return to its original geometry upon opening of the die. The above noted embodiments are merely exemplary and are not intended to be limited to the specific embodiment disclosed herein. Other variations are contemplated as would be appreciated by one skilled in the art in view of this disclosure. For example, multiple inserts can be employed using female and male portions having multiple features so as to produce a multitude of different parts having different geometries and/or surface textures.

The reconfigurable tools, dies, and/or inserts are especially attractive for manufacturing thermoplastic or thin sheet metal parts where the force required forming a part is relatively low. The particular shape memory material generally determines the constraint on the force level. Moreover, the reconfigurable tools, dies, and/or inserts are also suitable for use with injection molding processes. In addition, one of ordinary skill in the art will appreciate that the reconfigurable tools, dies, inserts can also be employed for rapid prototyping as well as for surface texturing. For example, the inserts can be employed to provide a change in texture to the blank as opposed to a change in geometry (shape).

As previously discussed, the shape memory material can also be utilized for reconfigurable fixtures and jigs. A fixture is generally used to hold the tools, wherein the tools are guided either manually or automatically using mechanical, servo-hydraulic, pneumatic, and/or electrical means. This generally involves complicated drive mechanisms, passive mechanisms such as cams, linkages drive screws, as well as other mechanisms that work in concert to achieve the required positioning and motion. A reconfigurable fixture as disclosed herein can employ wires or springs or patches or the like formed of the shape memory material to actively position the required tool in a desired sequence and to guide it by imparting the desired motion for achieving, for example, a depth of cut and feed to facilitate machining of the part. To fixedly position the fixture in a given position during machining, additional locking means may be employed. For example, the reconfigurable fixture may include an electromagnetic locking devices or mechanical locking pins to prevent undesirable motion of the fixture during machining.

Figure 8:
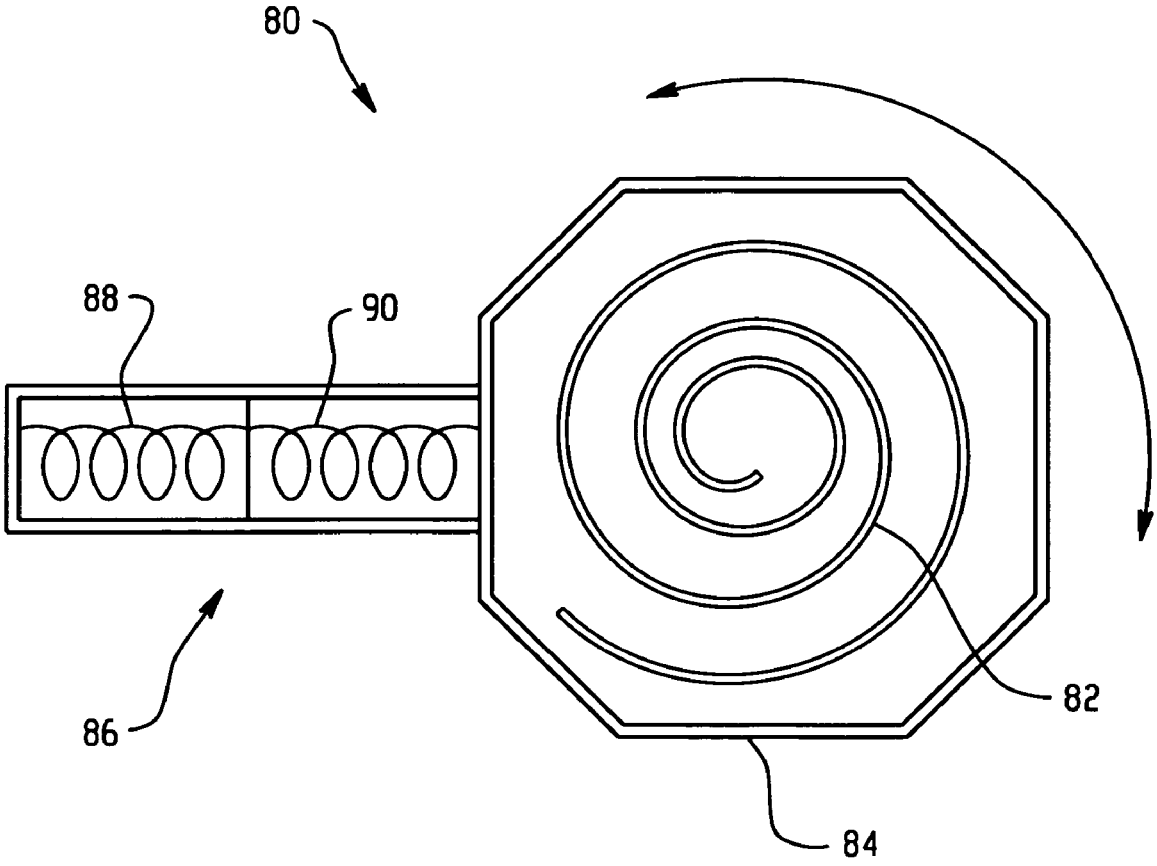
FIG. 8 schematically illustrates a reconfigurable fixture.

By way of example, FIG. 8 illustrates a top down view of a reconfigurable fixture 80 adapted for rotational positioning as well as axial, transverse, and translational positioning as may be desired for a fixture. For rotational positioning, the fixture can comprise a torsional spring 82 formed of the shape memory material disposed within a housing 84. Once the shape memory material is activated, the torsional spring 82 will cause the fixture to rotate as a result of the change in dimension from its original shape to its memorized shape. In this manner, the fixture 80 can be configured for different tool types, of which the amount of rotation can be programmed to permit the tools to be sequentially programmed to machine the part and/or component. The use of the torsional spring to effect rotation can be employed for the fixture itself and/or a jig attached thereto.

The fixture 80 can also include a linear motion device 86 within an arm extending from the housing 90 comprising the shape memory material. The linear motion device includes one or more linearly arranged springs 88 of the shape memory material disposed within the housing 90 for controlled axial and transverse motion. The fixture 80 may include one or more arms depending on the desired application. The various springs 82 and/or 88 have a memorized specific shape involving a predefined travel or elongation. By activating these springs by applying the requisite thermal, electrical, magnetic, or stress field, the desired positioning and motion of the fixture can be achieved. Bias springs or retracting mechanisms could also be use, if desired, to control the motion for imparting, for example, depth of cut and feed.

The advantage of using such an approach is active reconfiguration and sequencing, which are achieved through the use of relatively simple shape memory material based devices, in so doing eliminating and/or reducing the use of passive mechanisms like drive screws, cam, and the like. This helps in reducing friction, noise, and also simplifies the fixture design and operation. By a suitable electronic control to magnetically, electrically, thermally, and the like, activate these shape memory devices, the process can be automated and reprogrammed to achieve different sets of sequences of cutting tool operations. Moreover, precise motion and position can be achieved by the fixture, which enhances the quality of the machining process.

The above illustration shows, for simplicity, an instance wherein the stroke and depth control mechanisms are the same for all of the tools. If it is desired to control the stroke and depth of each tool individually, similar mechanisms may be provided to address those applications. Although specific reference has been made to the use of springs, those of ordinary skill in the art will appreciate that wires, tubes and/or rods can also be used in view of this disclosure. The shape memory material is in operative communication with a control mechanism (not shown) to provide a means for selective activation, and as such, selective rotation and/or translation.

In addition to the reconfigurable fixtures, the shape memory material can be adapted for jigs. Similar to the reconfigurable fixture outlined above, reconfigurable jigs can be used, with the major difference being that these are used to sequentially guide multiple parts that are to be machined.

Suitable shape memory materials for effecting the reconfiguration of the tools, dies, fixtures, and jigs are generally those materials wherein the shape and/or modulus properties can be selectively varied by means of an activation signal. In most applications, the shape memory material is selected to provide sufficient rigidity for the desired operation. For example, an insert formed of the shape memory material for use with standard tools and dies should have sufficient rigidity to impress a desired attribute to a part and/or component processed therein. For springs, it is desired that the modulus and/or shape dimension can be selectively varied to provide the desired movement. Optionally, it may be desired to supplement the shape memory spring with a biasing and/or support spring formed of a traditional material (i.e., no shape memory) to compensate for the forces exerted on the shape memory spring, if desired.

Suitable shape memory materials include, but are not intended to be limited to, shape memory alloys (SMA), shape memory polymers (SMP), electroactive polymers (EAP), ferromagnetic SMAs, magnetic SMAs, electrorheological fluids (ER), magnetorheological fluids (MR), dielectric elastomers, ionic polymer metal composites (IPMC), piezoelectrics, piezoceramics, various combinations of the foregoing materials, and the like. Although some of the above noted shape memory materials might not be suitable for some applications noted in the various embodiments disclosed herein, combinations of the various shape materials with these materials could be made to obtain the desired outcome. For example, MR fluids can be employed in combination with a shape memory spring to provide varying degrees of translation, wherein selectively activating the MR fluid locks a dimension of the spring, for example.

As previously discussed, some shape memory materials can exhibit a one-way shape memory effect, an intrinsic two-way effect, or an extrinsic two-way shape memory effect depending on the alloy composition and processing history. For example, annealed shape memory alloys typically only exhibit the one-way shape memory effect. Sufficient heating subsequent to low-temperature deformation of the shape memory material will induce the martensite to austenite type transition, and the material will recover the original, annealed shape. Hence, one-way shape memory effects are only observed upon heating. Shape memory materials comprising shape memory alloy compositions that exhibit one-way memory effects do not automatically reform, and will likely require an external mechanical force to reform the previous shape, if desired for the particular application.

Using shape memory alloys as an example, intrinsic and extrinsic two-way shape memory materials are characterized by a shape transition both upon heating from the martensite phase to the austenite phase, as well as an additional shape transition upon cooling from the austenite phase back to the martensite phase. Shape memory materials that exhibit an intrinsic shape memory effect can be fabricated from a shape memory alloy composition that will cause the shape memory materials to automatically reform themselves as a result of the above noted phase transformations. Intrinsic two-way shape memory behavior must be induced in the shape memory material through processing. Such procedures include extreme deformation of the material while in the martensite phase, heating-cooling under constraint or load, or surface modification such as laser annealing, polishing, or shot-peening. Once the material has been trained to exhibit the two-way shape memory effect, the shape change between the low and high temperature states is generally reversible and persists through a high number of thermal cycles. In contrast, shape memory materials that exhibit the extrinsic two-way shape memory effects are composite or multi-component materials that combine a shape memory alloy composition that exhibits a one-way effect with another element that provides a restoring force to reform the original shape.

Shape memory alloys are alloy compositions with at least two different temperature-dependent phases. The most commonly utilized of these phases are the so-called martensite and austenite phases. In the following discussion, the martensite phase generally refers to the more deformable, lower temperature phase whereas the austenite phase generally refers to the more rigid, higher temperature phase. When the shape memory alloy is in the martensite phase and is heated, it begins to change into the austenite phase. The temperature at which this phenomenon starts is often referred to as austenite start temperature ($A_s$). The temperature at which this phenomenon is complete is called the austenite finish temperature ($A_f$). When the shape memory alloy is in the austenite phase and is cooled, it begins to change into the martensite phase, and the temperature at which this phenomenon starts is referred to as the martensite start temperature ($M_s$). The temperature at which austenite finishes transforming to martensite is called the martensite finish temperature ($M_f$). It should be noted that the above-mentioned transition temperatures are functions of the stress experienced by the SMA sample. Specifically, these temperatures increase with increasing stress. In view of the foregoing properties, deformation of the shape memory alloy is preferably at or below the austenite transition temperature (at or below $A_s$). Subsequent heating above the austenite transition temperature causes the deformed shape memory material sample to revert back to its permanent shape. Thus, a suitable activation signal for use with shape memory alloys is a thermal activation signal having a magnitude that is sufficient to cause transformations between the martensite and austenite phases.

The temperature at which the shape memory alloy remembers its high temperature form when heated can be adjusted by slight changes in the composition of the alloy and through thermo-mechanical processing. In nickel-titanium shape memory alloys, for example, it can be changed from above about 100° C. to below about −100° C. The shape recovery process can occur over a range of just a few degrees or exhibit a more gradual recovery. The start or finish of the transformation can be controlled to within a degree or two depending on the desired application and alloy composition. The mechanical properties of the shape memory alloy vary greatly over the temperature range spanning their transformation, typically providing shape memory effect, superelastic effect, and high damping capacity. For example, in the martensite phase a lower elastic modulus than in the austenite phase is observed. Shape memory alloys in the martensite phase can undergo large deformations by realigning the crystal structure rearrangement with the applied stress, e.g., pressure from a matching pressure foot. As will be described in greater detail below, the material will retain this shape after the stress is removed.

Suitable shape memory alloy materials include, but are not intended to be limited to, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-palladium based alloys, and the like. The alloys can be binary, ternary, or any higher order so long as the alloy composition exhibits a shape memory effect, e.g., change in shape, orientation, yield strength, flexural modulus, damping capacity, superelasticity, and/or similar properties. Selection of a suitable shape memory alloy composition depends on the temperature range where the component will operate.

As noted above, shape recovery occurs when the shape memory alloy SMA undergoes deformation while in the malleable low-temperature phase and then encounters heat greater than transformation temperature (i.e., austenite finish temperature). Recovery pressures can exceed 400 megapascals (60,000 psi). Recoverable strain is as much as about 8% (about 4% to about 5% for the copper alloys) for a single recovery cycle and generally drops as the number of cycles increases.

Shape memory polymer generally refers to a polymeric material, which exhibits a change in a property, such as an elastic modulus, a shape, a dimension, a shape orientation, or a combination comprising at least one of the foregoing properties upon application of a thermal activation signal.

Generally, SMPs are phase segregated co-polymers comprising at least two different units, which may be described as defining different segments within the SMP, each segment contributing differently to the overall properties of the SMP. As used herein, the term "segment" refers to a block, graft, or sequence of the same or similar monomer or oligomer units, which are copolymerized to form the SMP. Each segment may be crystalline or amorphous and will have a corresponding melting point or glass transition temperature (Tg), respectively. The term "thermal transition temperature" is used herein for convenience to generically refer to either a Tg or a melting point depending on whether the segment is an amorphous segment or a crystalline segment. For SMPs comprising (n) segments, the SMP is said to have a hard segment and (n−1) soft segments, wherein the hard segment has a higher thermal transition temperature than any soft segment. Thus, the SMP has (n) thermal transition temperatures. The thermal transition temperature of the hard segment is termed the "last transition temperature", and the lowest thermal transition temperature of the so-called "softest" segment is termed the "first transition temperature". It is important to note that if the SMP has multiple segments characterized by the same thermal transition temperature, which is also the last transition temperature, then the SMP is said to have multiple hard segments.

When the SMP is heated above the last transition temperature, the SMP material can be shaped. A permanent shape for the SMP can be set or memorized by subsequently cooling the SMP below that temperature. As used herein, the terms "original shape", "previously defined shape", and "permanent shape" are synonymous and are intended to be used interchangeably. A temporary shape can be set by heating the material to a temperature higher than a thermal transition temperature of any soft segment yet below the last transition temperature, applying an external stress or load to deform the SMP, and then cooling below the particular thermal transition temperature of the soft segment while maintaining the deforming external stress or load.

The permanent shape can be recovered by heating the material, with the stress or load removed, above the particular thermal transition temperature of the soft segment yet below the last transition temperature. Thus, it should be clear that by combining multiple soft segments it is possible to demonstrate multiple temporary shapes and with multiple hard segments it may be possible to demonstrate multiple permanent shapes. Similarly using a layered or composite approach, a combination of multiple SMPs will demonstrate transitions between multiple temporary and permanent shapes.

For SMPs with only two segments, the temporary shape of the shape memory polymer is set at the first transition temperature, followed by cooling of the SMP, while under load, to lock in the temporary shape. The temporary shape is maintained as long as the SMP remains below the first transition temperature. The permanent shape is regained when the SMP is once again brought above the first transition temperature with the load removed. Repeating the heating, shaping, and cooling steps can repeatedly reset the temporary shape.

Most SMPs exhibit a "one-way" effect, wherein the SMP exhibits one permanent shape. Upon heating the shape memory polymer above a soft segment thermal transition temperature without a stress or load, the permanent shape is achieved and the shape will not revert back to the temporary shape without the use of outside forces.

As an alternative, some shape memory polymer compositions can be prepared to exhibit a "two-way" effect, wherein the SMP exhibits two permanent shapes. These systems include at least two polymer components. For example, one component could be a first cross-linked polymer while the other component is a different cross-linked polymer. The components are combined by layer techniques, or are interpenetrating networks, wherein the two polymer components are cross-linked but not to each other. By changing the temperature, the shape memory polymer changes its shape in the direction of a first permanent shape or a second permanent shape. Each of the permanent shapes belongs to one component of the SMP. The temperature dependence of the overall shape is caused by the fact that the mechanical properties of one component ("component A") are almost independent from the temperature in the temperature interval of interest. The mechanical properties of the other component ("component B") are temperature dependent in the temperature interval of interest. In one embodiment, component B becomes stronger at low temperatures compared to component A, while component A is stronger at high temperatures and determines the actual shape. A two-way memory device can be prepared by setting the permanent shape of component A ("first permanent shape"), deforming the device into the permanent shape of component B ("second permanent shape"), and fixing the permanent shape of component B while applying a stress.

It should be recognized by one of ordinary skill in the art that it is possible to configure SMPs in many different forms and shapes. Engineering the composition and structure of the polymer itself can allow for the choice of a particular temperature for a desired application. For example, depending on the particular application, the last transition temperature may be about 0° C. to about 300° C. or above. A temperature for shape recovery (i.e., a soft segment thermal transition temperature) may be greater than or equal to about −30° C. Another temperature for shape recovery may be greater than or equal to about 40° C. Another temperature for shape recovery may be greater than or equal to about 100° C. Another temperature for shape recovery may be less than or equal to about 250° C. Yet another temperature for shape recovery may be less than or equal to about 200° C. Finally, another temperature for shape recovery may be less than or equal to about 150° C.

Optionally, the SMP can be selected to provide stress-induced yielding, which may be used directly (i.e. without heating the SMP above its thermal transition temperature to 'soften' it) to make it conform to a given surface. The maximum strain that the SMP can withstand in this case can, in some embodiments, be comparable to the case when the SMP is deformed above its thermal transition temperature.

Suitable shape memory polymers can be thermoplastics, thermosets, interpenetrating networks, semi-interpenetrating networks, or mixed networks. The polymers can be a single polymer or a blend of polymers. The polymers can be linear or branched thermoplastic elastomers with side chains or dendritic structural elements. Suitable polymer components to form a shape memory polymer include, but are not limited to, polyphosphazenes, poly(vinyl alcohols), polyamides, polyester amides, poly(amino acid)s, polyanhydrides, polycarbonates, polyacrylates, polyalkylenes, polyacrylamides, polyalkylene glycols, polyalkylene oxides, polyalkylene terephthalates, polyortho esters, polyvinyl ethers, polyvinyl esters, polyvinyl halides, polyesters, polylactides, polyglycolides, polysiloxanes, polyurethanes, polyethers, polyether amides, polyether esters, and copolymers thereof. Examples of suitable polyacrylates include poly(methyl methaciylate), poly(ethyl methacrylate), poly(butyl methacrylate), poly (isobutyl methacrylate), poly(hexyl methacrylate), poly(isodecyl methacrylate), poly(lauryl mnethacrylate), poly(phenyl methacrylate), poly(methyl acrylate), poly(isopropyl acrylate), poly(isobutyl acrylate) and poly(octadecylacrylate). Examples of other suitable polymers include polystyrene, polypropylene, polyvinyl phenol, polyvinylpyrrolidone, chlorinated polybutylene, poly(octadecyl vinyl ether), ethylene vinyl acetate, polyethylene, poly(ethylene oxide)-poly(ethylene terephthalate), polyethylene/nylon (graft copolymer), polycaprolactones-polyamide (block copolymer), poly(caprolactone) diniethacrylate-n-butyl acrylate, poly(norbornyl-polyhedral oligomeric silsequioxane), polyvinylchloride, urethane/butadiene copolymers, polyurethane block copolymers, styrene-butadienestyrene block copolymers, and the like. The polymer(s) used to form the various segments in the SMPs described above are either commercially available or can be synthesized using routine chemistry. Those of skill in the art can readily prepare the polymers using known chemistry and processing techniques without undue experimentation.

The shape memory material may also comprise an electroactive polymer—two classes of which are electronic and ionic EAP's (electroactive polymers)—examples of which include ionic polymer metal composites, conductive polymers, piezoelectric material, and the like.

Electroactive polymers include those polymeric materials that exhibit piezoelectric, pyroelectric, or electrostrictive properties in response to electrical or mechanical fields. The materials generally employ the use of compliant electrodes that enable polymer films to expand or contract in the in-plane directions in response to applied electric fields or mechanical stresses. An example of an electrostrictive-grafted elastomer with a piezoelectric poly(vinylidene fluoride-trifluoro-ethylene) copolymer. This combination has the ability to produce a varied amount of ferroelectric-electrostrictive molecular composite systems. These may be operated as a piezoelectric sensor or even an electrostrictive actuator.

Materials suitable for use as an electroactive polymer may include any substantially insulating polymer or rubber (or combination thereof) that deforms in response to an electrostatic force or whose deformation results in a change in electric field. Exemplary materials suitable for use as a pre-strained polymer include silicone elastomers, acrylic elastomers, polyurethanes, thermoplastic elastomers, copolymers comprising PVDF, pressure-sensitive adhesives, fluoroelastomers, polymers comprising silicone and acrylic moieties, and the like. Polymers comprising silicone and acrylic moieties may include copolymers comprising silicone and acrylic moieties, polymer blends comprising a silicone elastomer and an acrylic elastomer, for example.

Materials used as an electroactive polymer may be selected based on one or more material properties such as a high electrical breakdown strength, a low modulus of elasticity (for large or small deformations), a high dielectric constant, and the like. In one embodiment, the polymer is selected such that is has an elastic modulus at most about 100 MPa. In another embodiment, the polymer is selected such that is has a maximum actuation pressure between about 0.05 MPa and about 10 MPa, and preferably between about 0.3 MPa and about 3 MPa. In another embodiment, the polymer is selected such that is has a dielectric constant between about 2 and about 20, and preferably between about 2.5 and about 12. The present disclosure is not intended to be limited to these ranges. Ideally, materials with a higher dielectric constant than the ranges given above would be desirable if the materials had both a high dielectric constant and a high dielectric strength. In many cases, electroactive polymers may be fabricated and implemented as thin films. Thicknesses suitable for these thin films may be below 50 micrometers.

As electroactive polymers may deflect at high strains, electrodes attached to the polymers should also deflect without compromising mechanical or electrical performance. Generally, electrodes suitable for use may be of any shape and material provided that they are able to supply a suitable voltage to, or receive a suitable voltage from, an electroactive polymer. The voltage may be either constant or varying over time. In one embodiment, the electrodes adhere to a surface of the polymer. Electrodes adhering to the polymer are preferably compliant and conform to the changing shape of the polymer. Correspondingly, the present disclosure may include compliant electrodes that conform to the shape of an electroactive polymer to which they are attached. The electrodes may be only applied to a portion of an electroactive polymer and define an active area according to their geometry. Various types of electrodes suitable for use with the present disclosure include structured electrodes comprising metal traces and charge distribution layers, textured electrodes comprising varying out of plane dimensions, conductive greases such as carbon greases or silver greases, colloidal suspensions, high aspect ratio conductive materials such as carbon fibrils and carbon nanotubes, and mixtures of ionically conductive materials.

Materials used for electrodes of the present disclosure may vary. Suitable materials used in an electrode may include graphite, carbon black, colloidal suspensions, thin metals including silver and gold, silver filled and carbon filled gels and polymers, and ionically or electronically conductive polymers. It is understood that certain electrode materials may work well with particular polymers and may not work as well for others. By way of example, carbon fibrils work well with acrylic elastomer polymers while not as well with silicone polymers.

As used herein, the term "piezoelectric" is used to describe a material that mechanically deforms when a voltage potential is applied, or conversely, generates an electrical charge when mechanically deformed. Preferably, the piezoelectric material is disposed on strips of a flexible metal or ceramic sheet. The strips can be unimorph or bimorph. Preferably, the strips are bimorph, because bimorphs generally exhibit more displacement than unimorphs.

One type of unimorph is a structure composed of a single piezoelectric element externally bonded to a flexible metal foil or strip, which is stimulated by the piezoelectric element when activated with a changing voltage and results in an axial buckling or deflection as it opposes the movement of the piezoelectric element. The actuator movement for a unimorph can be by contraction or expansion. Unimorphs can exhibit a strain of as high as about 10%, but generally can only sustain low loads relative to the overall dimensions of the unimorph structure.

In contrast to the unimorph piezoelectric device, a bimorph device includes an intermediate flexible metal foil sandwiched between two piezoelectric elements. Bimorphs exhibit more displacement than unimorphs because under the applied voltage one ceramic element will contract while the other expands. Bimorphs can exhibit strains up to about 20%, but similar to unimorphs, generally cannot sustain high loads relative to the overall dimensions of the unimorph structure.

Suitable piezoelectric materials include inorganic compounds, organic compounds, and metals. With regard to organic materials, all of the polymeric materials with non-centrosymmetric structure and large dipole moment group(s) on the main chain or on the side-chain, or on both chains within the molecules, can be used as candidates for the piezoelectric film. Examples of suitable polymers include, for example, but are not limited to, poly(sodium 4-styrenesulfonate) ("PSS"), poly S-(poly(vinylamine)backbone azo chromophore), and their derivatives; polyfluorocarbons, including polyvinylidene fluoride ("PVDF"), its co-polymer vinylidene fluoride ("VDF"), trifluoroethylene (TrFE), and their derivatives; polychlorocarbons, including poly(vinyl chloride) ("PVC"), polyvinylidene chloride ("PVC2"), and their derivatives; polyacrylonitriles ("PAN"), and their derivatives; polycarboxylic acids, including poly (methacrylic acid ("PMA"), and their derivatives; polyureas, and their derivatives; polyurethanes ("PUE"), and their derivatives; bio-polymer molecules such as poly-L-lactic acids and their derivatives, and membrane proteins, as well as phosphate bio-molecules; polyanilines and their derivatives, and all of the derivatives of tetramines; polyimides, including Kapton molecules and polyetherimide ("PEI"), and their derivatives; all of the membrane polymers; poly (N-vinyl pyrrolidone) ("PVP") homopolymer, and its derivatives, and random PVP-co-vinyl acetate ("PVAc") copolymers; and all of the aromatic polymers with dipole moment groups in the main-chain or side-chains, or in both the main-chain and the side-chains, and mixtures thereof.

Further, piezoelectric materials can include Pt, Pd, Ni, Ti, Cr, Fe, Ag, Au, Cu, and metal alloys and mixtures thereof. These piezoelectric materials can also include, for example, metal oxide such as $SiO_2$, $Al_2O_3$, $ZrO_2$, $TiO_2$, $SrTiO_3$, $PbTiO_3$, $BaTiO_3$, $FeO_3$, $Fe_3O_4$, ZnO, and mixtures thereof; and Group VIA and IIB compounds, such as CdSe, CdS, GaAs, $AgCaSe_2$, ZnSe, GaP, InP, ZnS, and mixtures thereof.

Suitable MR elastomer materials include, but are not intended to be limited to, an elastic polymer matrix comprising a suspension of ferromagnetic or paramagnetic particles, wherein the particles are described above. Suitable polymer matrices include, but are not limited to, poly-alpha-olefins, natural rubber, silicone, polybutadiene, polyethylene, polyisoprene, and the like.

Suitable shape memory materials can also comprise magnetorheological (MR) compositions, such as MR elastomers, which are known as "smart" materials whose rheological properties can rapidly change upon application of a magnetic field. MR elastomers are suspensions of micrometer-sized, magnetically polarizable particles in a thermoset elastic polymer or rubber. The stiffness of the elastomer structure is accomplished by changing the shear and compression/tension moduli by varying the strength of the applied magnetic field. The MR elastomers typically develop structure when exposed to a magnetic field in as little as a few milliseconds. Discontinuing the exposure of the MR elastomers to the magnetic field reverses the process and the elastomer returns to its lower modulus state.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A reconfigurable tool and/or die set, comprising:

a male die comprising a shape defining surface, wherein the male die is formed of the shape memory material;

a female die comprising a shape defining surface; and wherein the shape memory material selectively changes a geometry of the selected one or both of the shape defining surfaces in response to an activation signal.

2. The reconfigurable tool and/or die set of claim 1, wherein the shape memory material comprises a shape memory polymer, a shape memory alloy, an electroactive polymer, a ferromagnetic shape memory alloy, a magnetic shape memory alloy, an electrorheological fluid; a magnetorheological fluid, a dielectric elastomer, an ionic polymer metal composites, a piezoelectric polymer, a piezoelectric ceramic, and combinations comprising at least one of the foregoing shape memory materials.

3. The reconfigurable tool and/or die set of claim 1, wherein the female die is formed of the shape memory material.

4. The reconfigurable tool and/or die set of claim 1, wherein the activation signal comprises a magnetic signal, a thermal signal, an electrical signal, a stress signal, and combinations comprising at least one of the foregoing activation signals.

5. The reconfigurable tool and/or die set of claim 1, wherein the shape memory material is selected to exhibit a one-way shape memory effect.

6. The reconfigurable tool and/or die set of claim 1, wherein the shape memory material is selected to exhibit a two-way shape memory effect.

7. An insert for a tool and/or die set, comprising:

a shape memory material having a shape defining first surface adapted to change to a shape defining second surface in response to an activation signal, wherein the first and second surfaces have different geometries.

8. The insert of claim 7, wherein the shape memory material is selected to exhibit a one-way shape memory effect.

9. The insert of claim 7, wherein the shape memory material is selected to exhibit a two-way shape memory effect.

10. The insert of claim 7, wherein the shape memory material comprises a shape memory polymer, a shape memory alloy, an electroactive polymer, a ferromagnetic shape memory alloy, a magnetic shape memory alloy, an electrorheological fluid, a magnetorheological fluid, a dielectric elastomer, an ionic polymer metal composites, a piezoelectric polymer, a piezoelectric ceramic, and combinations comprising at least one of the foregoing shape memory materials.

11. A process for forming a first part with a defined geometry and a second part with a defined geometry different from the first part defined geometry using a reconfigurable tool and/or die set, the process comprising:

forming the first part with the reconfigurable tool and/or die set, wherein the reconfigurable tool and/or die set comprises a shape defining surface comprising at least a portion formed of a shape memory material, wherein forming the first part with the reconfigurable tool and/or die set produces the first part with the defined geometry;

activating the shape memory material to change the shape defining surface; and forming the second part with the changed shape defining surface to produce the second part with the defined geometry, wherein the second part defined geometry differs from the first part defined geometry.

12. The process of claim 11, wherein activating the shape memory material comprises delivering an activation signal comprising a magnetic signal, a thermal signal, an electrical signal, a stress signal, and combinations comprising at least one of the foregoing activation signals.

13. The process of claim 11, wherein the shape defining surface comprising the at least a portion formed of the shape memory material is an insert.

14. The process of claim 11, wherein the shape memory material comprises a shape memory polymer, a shape memory alloy, an electroactive polymer, a ferromagnetic shape memory alloy, a magnetic shape memory alloy, an electrorheological fluid, a magnetorheological fluid, a dielectric elastomer, an ionic polymer metal composites, a piezoelectric polymer, a piezoelectric ceramic, and combinations comprising at least one of the foregoing shape memory materials.

15. The process of claim 11, wherein the shape memory material is selected to exhibit a one-way shape memory effect.

16. The process of claim 11, wherein the shape memory material is selected to exhibit a two-way shape memory effect.

17. A process for forming a first part with a defined geometry and a second part with a defined geometry different from the first part defined geometry using a tool and/or die set, the process comprising:

inserting an insert into a tool and/or die set, wherein the insert comprises a shape memory material having at least one shape defining first surface adapted to change to a shape defining second surface in response to an activation signal, wherein the first and second shape defining surfaces have different geometries;

contacting a blank with the insert and the tool and/or die set to form the first part with the defined geometry;

activating the shape memory material to change the shape defining first surface to a shape defining second surface; and contacting an additional blank or the first part with the shape defining second surface of the insert and the tool and/or die set to form the second part with the defined geometry, wherein the second part defined geometry differs from the first part defined geometry.

18. The process of claim 17, wherein the shape memory material is selected to exhibit a one-way shape memory effect.

19. The process of claim 17, wherein the shape memory material is selected to exhibit a two-way shape memory effect.

20. The process of claim 17, wherein the shape memory material comprises a shape memory polymer, a shape memory alloy, an electroactive polymer, a ferromagnetic shape memory alloy, a magnetic shape memory alloy, an electrorheological fluid, a magnetorheological fluid, a dielectric elastomer, an ionic polymer metal composites, a piezoelectric polymer, a piezoelectric ceramic, and combinations comprising at least one of the foregoing shape memory materials.

21. The process of claim 18, further comprising restamping the shape memory material after deactivation to restore the insert to the at least one shape defining first surface.

22. A fixture for holding a tool, the fixture comprising:

a housing rotatably coupled to a torsional spring, the torsional spring comprising a shape memory material that changes at least one attribute of the shape memory material in response to an activation signal, wherein the change in the at least one attribute rotates the housing about a central axis; and an arm extending from the housing.

23. The fixture of claim 22, wherein the arm comprises a linear motion device for translation, the linear motion device comprising the shape memory material, wherein the change in the at least one attribute translates the arm.

* * * * *